US012078351B2

(12) United States Patent
Gresy et al.

(10) Patent No.: US 12,078,351 B2
(45) Date of Patent: Sep. 3, 2024

(54) DOUBLE WALL FOR AIRCRAFT GAS TURBINE COMBUSTION CHAMBER AND METHOD OF PRODUCING SAME

(71) Applicant: SAFRAN HELICOPTER ENGINES, Bordes (FR)

(72) Inventors: Thomas Sébastien Alexandre Gresy, Moissy-Cramayel (FR); Jean-Paul Didier Autret, Moissy-Cramayel (FR); Nicolas Roland Guy Savary, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 0 days.

(21) Appl. No.: 18/258,356

(22) PCT Filed: Dec. 20, 2021

(86) PCT No.: PCT/EP2021/086791
§ 371 (c)(1),
(2) Date: Jun. 20, 2023

(87) PCT Pub. No.: WO2022/144206
PCT Pub. Date: Jul. 7, 2022

(65) Prior Publication Data

US 2024/0044492 A1 Feb. 8, 2024

(30) Foreign Application Priority Data

Jan. 4, 2021 (FR) ..... 2100013

(51) Int. Cl.
*F23R 3/00* (2006.01)

(52) U.S. Cl.
CPC ..... *F23R 3/005* (2013.01); *F23R 3/002* (2013.01); *F23R 2900/03043* (2013.01)

(58) Field of Classification Search
CPC ..... F23R 3/005; F23R 3/002; F23R 2900/03043; F23R 2900/03044
See application file for complete search history.

(56) References Cited

U.S. PATENT DOCUMENTS 4,916,905 A * 4/1990 Havercroft ..... F23R 3/10 60/757
5,353,865 A * 10/1994 Adiutori ..... F28F 13/185 165/908

(Continued)

FOREIGN PATENT DOCUMENTS

FR 3072448 A1 4/2019
JP S62-35001 A 2/1987

OTHER PUBLICATIONS

International Search Report from corresponding application No. PCT/EP2021/086791, dated Apr. 5, 2022, 2 pages.

(Continued)

*Primary Examiner* — Steven M Sutherland
(74) *Attorney, Agent, or Firm* — RANKIN, HILL & CLARK LLP

(57) ABSTRACT

A double wall for an aircraft gas turbine combustion chamber comprising an internal wall which is configured to be in contact with the combustion reaction, and an external wall which is at a distance from the internal wall, comprising a plurality of openings so as to allow the circulation of cooling air streams, outside the external wall, which cool the internal wall. The internal wall being free of perforations to prevent any circulation of a cooling air stream towards the centre of the combustion chamber. The the internal wall comprises a plurality of members projecting towards the external wall, each projecting member comprising a foot portion and a cylindrical head portion with a circular cross-section, the head portion extending into an opening with a circular cross-section so as to define a calibrated cross-sectional area (Continued)

between the projecting member and the opening, through which area a cooling air stream can flow.

8 Claims, 5 Drawing Sheets

(56) References Cited

U.S. PATENT DOCUMENTS

| | | | | |
|---|---|---|---|---|
| 10,830,448 | B2 * | 11/2020 | Pacheco-Tougas ..... | F23R 3/002 |
| 2013/0047618 | A1 | 2/2013 | Gregory | |
| 2017/0356652 | A1 | 12/2017 | Singh et al. | |
| 2017/0370586 | A1 | 12/2017 | Okita et al. | |
| 2019/0195496 | A1 | 6/2019 | Moura et al. | |

OTHER PUBLICATIONS

French Search Report from corresponding application No. FR 2100013, dated Sep. 16, 2021, 2 pages.

* cited by examiner

DOUBLE WALL FOR AIRCRAFT GAS TURBINE COMBUSTION CHAMBER AND METHOD OF PRODUCING SAME

TECHNICAL FIELD

The present invention relates to the field of aircraft gas turbine combustion chambers, in particular, for helicopter.

In a known manner, with reference to FIG. 1, a combustion chamber 101 comprises a double wall 102, namely an inner wall 121 in contact with the combustion reaction R and an outer wall 122 that forms a heat shield. In order to limit heat propagation from the inner wall 121, it is known to provide ports 103 in the outer wall 122 so as to allow circulation of cooling air flows F which cool the inner wall 121 by impact and thus increase its lifetime. In order to make it possible to manufacture the double wall 2 and ensure a spacing between the inner wall 121 and the outer wall 122, it is known to provide bridges 104 connecting the inner wall 121 and the outer wall 122 as illustrated in FIG. 1. In practice, the bridges 104 are mounted in an assembled manner, in particular by welding to the walls 121, 122 of the double wall 102. In prior art, for example, such bridges are known from patent application FR3072448A1.

In operation, during the combustion reaction R, the temperature of the inner wall 121 is higher than that of the outer wall 122, which, due to thermal expansions, results in a relative displacement between the inner wall 121 and the outer wall 122. The bridges 104 are thereby likely to break as illustrated in FIG. 2, which modifies the spacing between the inner wall 121 and the outer wall 122. Also, the cooling air flow F is likely to be diverted at the break zones of the bridges 104. As a result, cooling of the inner wall 121 is not optimal. The inner wall 121 may comprise high temperature zones Z, which affects its lifetime.

An immediate solution to eliminate this drawback would be to strengthen the linkage of each bridge, but this entails significant time and cost of manufacture. Thus, the invention aims to eliminate at least some of these drawbacks.

In prior art from patent application US20130047618A1 a double wall for a combustion chamber of a gas turbine comprising bump-shaped protrusions is known.

SUMMARY

The invention relates to a double wall for aircraft gas turbine combustion chamber comprising an inner wall configured to be in contact with the combustion reaction and an outer wall, spaced apart from the inner wall, comprising a plurality of ports so as to allow circulation of cooling air flows, external to the outer wall, which cool the inner wall. The inner wall is free of perforation so as to prohibit any circulation of air flow to the center of the combustion chamber.

The invention is remarkable in that the inner wall comprises a plurality of members projecting towards the outer wall, each projecting member extending into a port so as to define a calibrated flow cross-section between the projecting member and the port for the passage of a cooling air flow.

Advantageously, the plurality of projecting members allows the exchange surface between the cooling air flow and the inner wall to be increased, which improves the life time of the combustion chamber. In addition, the positioning of the projecting member in a port allows a calibrated flow cross-section to be defined, which allows the cooling air flow to be accurately regulated. Finally, such projecting members do not have a significant thermal gradient during use, which increases the life time. Finally, such projecting members are used to support the inner wall during additive manufacturing.

Preferably, since each port has a peripheral edge, each projecting member extends away from the peripheral edge of the port. Thus, there is no direct heat conduction between the projecting member and the outer wall. In addition, this allows differential expansion during operation given that the wall temperatures are different.

Preferably, each projecting member is distant from the outer wall, that is without contact, so as to avoid any heat conduction. The projecting members are advantageously free in relation to the outer wall.

Advantageously, the cooling air flow circulate peripherally about each projecting member, which improves cooling. Preferably, the calibrated flow cross-section is peripheral, preferably annular.

According to one aspect of the invention, each projecting member has a flared cross-section towards the inner wall. As a result, the projecting member has a robust base, which increases the life time.

Preferably, the outer wall comprises an outer face, each projecting member having an end face extending as an extension of the outer face of the outer wall. This is advantageous given that it improves the circulation of cooling air flow by avoiding forming a relief pattern likely to lead to formation of turbulence. Such a characteristic is advantageously obtained during additive manufacturing as will be set forth later.

According to one preferred aspect of the invention, the double wall is additively manufactured. Such a manufacturing method ensures precise positioning of the projecting member in a port.

The invention also relates to a method for manufacturing a double wall as set forth previously, wherein the inner wall and the outer wall are additively manufactured.

Preferably, the inner wall and the outer wall are secured to a temporary support by incremental addition of metal powders, then unsecured from the temporary support by cutting at the interface between the walls and the temporary support. Preferably, prior to unsecuring, the assembly is depowdered and then heat treated.

The invention also relates to an aircraft gas turbine combustion chamber comprising a double wall as set forth previously, wherein the inner wall is configured to be in contact with the combustion reaction.

The invention also relates to a gas turbine, in particular for aircraft, comprising a combustion chamber as set forth previously.

The invention is also directed to a method for using a combustion chamber as set forth previously, comprising:

- a combustion step in the combustion chamber raising the temperature of the inner wall and
- a step of circulating a cooling air flow from the outside via each calibrated flow cross-section of the outer wall, defined between a projecting member and the port into which it extends, so as to cool the inner wall.

Preferably, as each projecting member expands thermally, each projecting member in the expanded state extends away from the peripheral edge of the port into which it extends.

DESCRIPTION OF THE DRAWINGS

The invention will be better understood upon reading the following description, given as an example, and by referring to the following figures, given as non-limiting examples, wherein identical references are given to similar objects.

It should be noted that the figures set out the invention in detail in order to implement the invention, said figures may of course be used to better define the invention if necessary.

DETAILED DESCRIPTION

Figure 1:
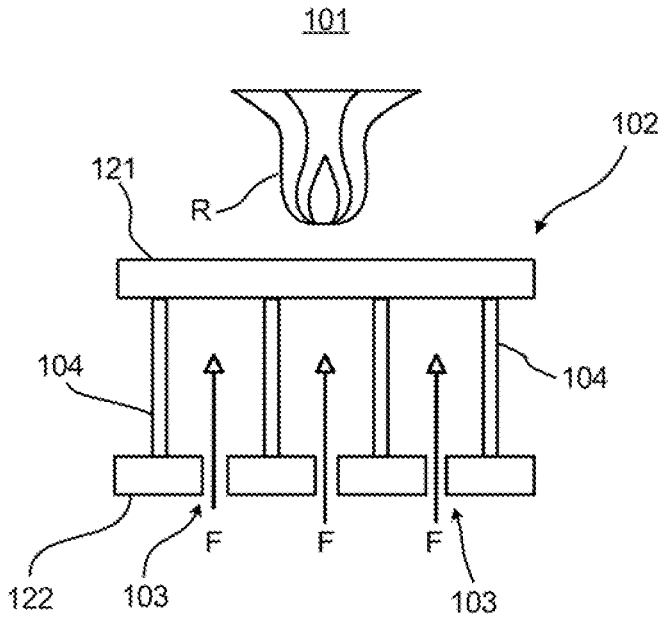
FIG. 1 is a schematic representation of a double wall of a combustion chamber with bridges according to prior art.
Figure 2:
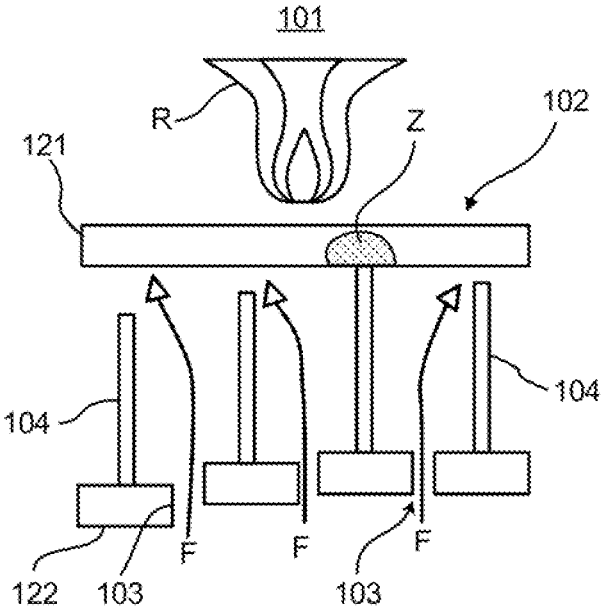
FIG. 2 is a schematic representation of the double wall of FIG. 1 upon breaking the bridge linkage.
Figure 3:
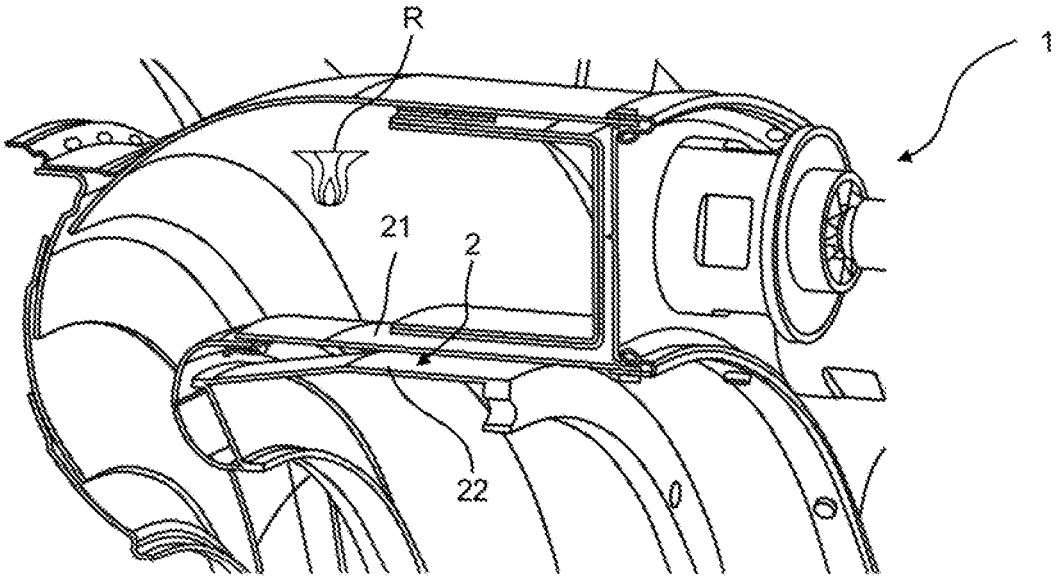
FIG. 3 is a schematic representation of a combustion chamber of a helicopter gas turbine.

The invention will be set forth for an aircraft gas turbine combustion chamber. With reference to FIG. 3, a combustion chamber 1 of a helicopter gas turbine is represented. It goes without saying that the invention also applies to other types of aircraft gas turbines.

By combustion chamber, it is advantageously meant any enclosure in which a combustion reaction is carried out and whose temperature should be controlled.

As illustrated in FIG. 3 which is schematic, the combustion chamber 1 comprises a double wall 2 comprising an inner wall 21 configured to be in contact with the combustion reaction R and an outer wall 22, spaced apart from the inner wall 21, in order to form a heat shield. Preferably, the walls 21, 22 are metallic. The double wall 2 is represented in more detail in FIGS. 4 to 6.

Figure 4:
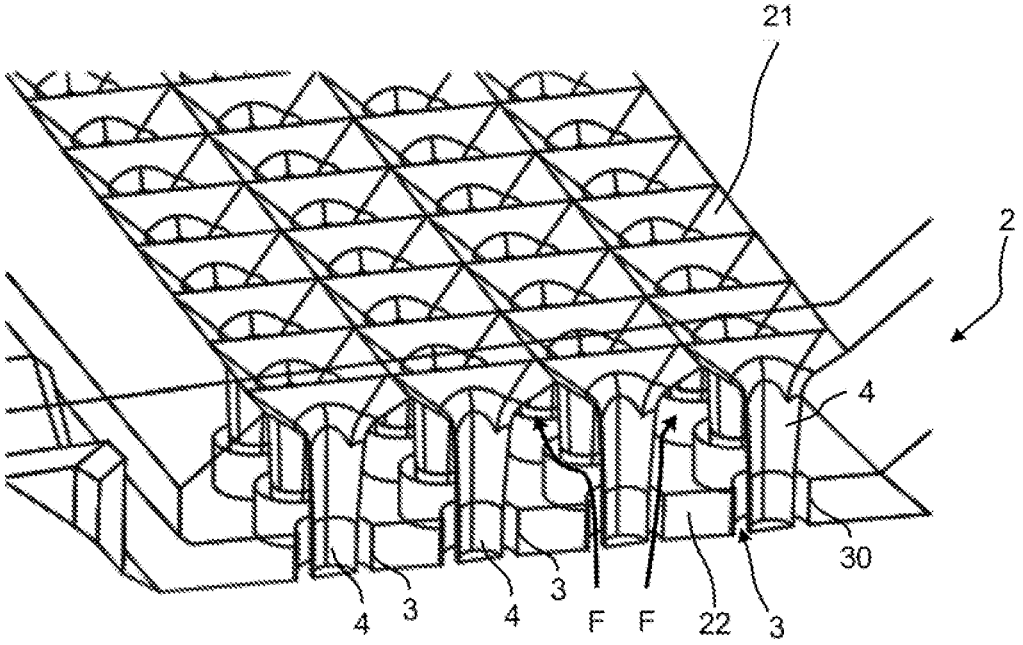
FIG. 4 is a schematic cross-section view of a double wall of a combustion chamber.
Figure 5:
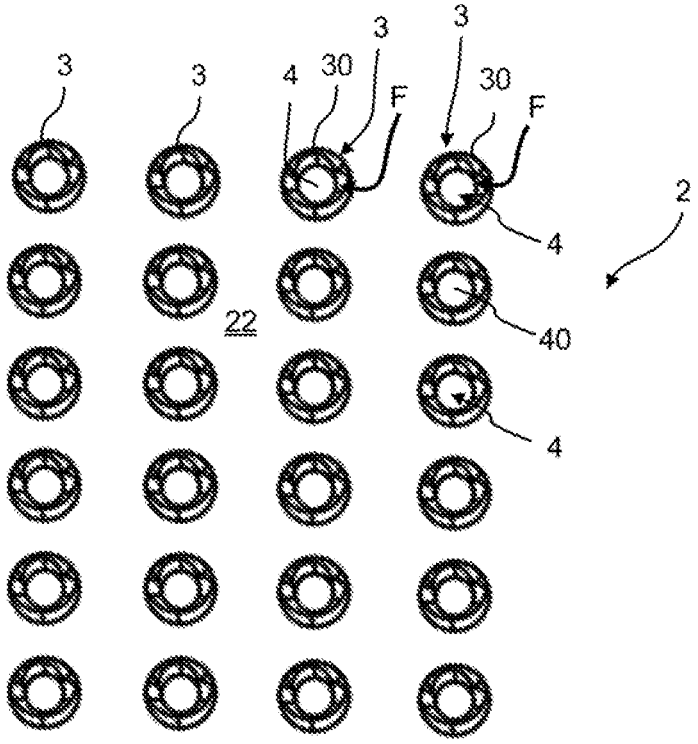
FIG. 5 is a schematic representation from outside of the double wall of FIG. 4.

As illustrated in FIGS. 4 and 5, the outer wall 22 comprises a plurality of ports 3 so as to allow circulation of cooling air flows F which cool the inner wall 21 by circulation in the spacing space formed between both walls 21, 22. The ports 3 are distributed on the external wall 22 so as to allow homogeneous cooling. With reference to FIG. 5, the ports 3 are arranged in rows and columns. of Preferably, the ports 3 are of circular cross-section and have a radius r3 (FIG. 6), but it goes without saying that they could be of a different cross-section. Each port 3 comprises a peripheral edge 30 which in this example is circular. According to one aspect of the invention, the number of ports 3 is higher in the zones facing the inner wall 21 which are the hottest.

The inner wall 21 is impermeable, that is, free of perforation so as to prohibit any circulation of a cooling air flow F towards the center of the combustion chamber 1, which would impact combustion performance. Such an inner wall 21 enables the combustion efficiency of the combustion chamber to be improved.

According to the invention, the inner wall 21 comprises a plurality of projecting members 4 towards the outer wall 22, each projecting member 4 extending into a port 3 so as to define a calibrated flow cross-section for the passage of the cooling air flow F. In this example, each port 3 is associated with a projecting member 4. It goes without saying that some ports 3 could be free of projecting member 4.

Advantageously, the projecting members 4 make it possible to increase the heat exchange surface area of the inner wall 21 with the cooling air flows F, which improves cooling of the inner wall 21. In addition, a calibrated flow cross-section allows precise control of the cooling air flow F in order to use it sparingly.

Figure 6:
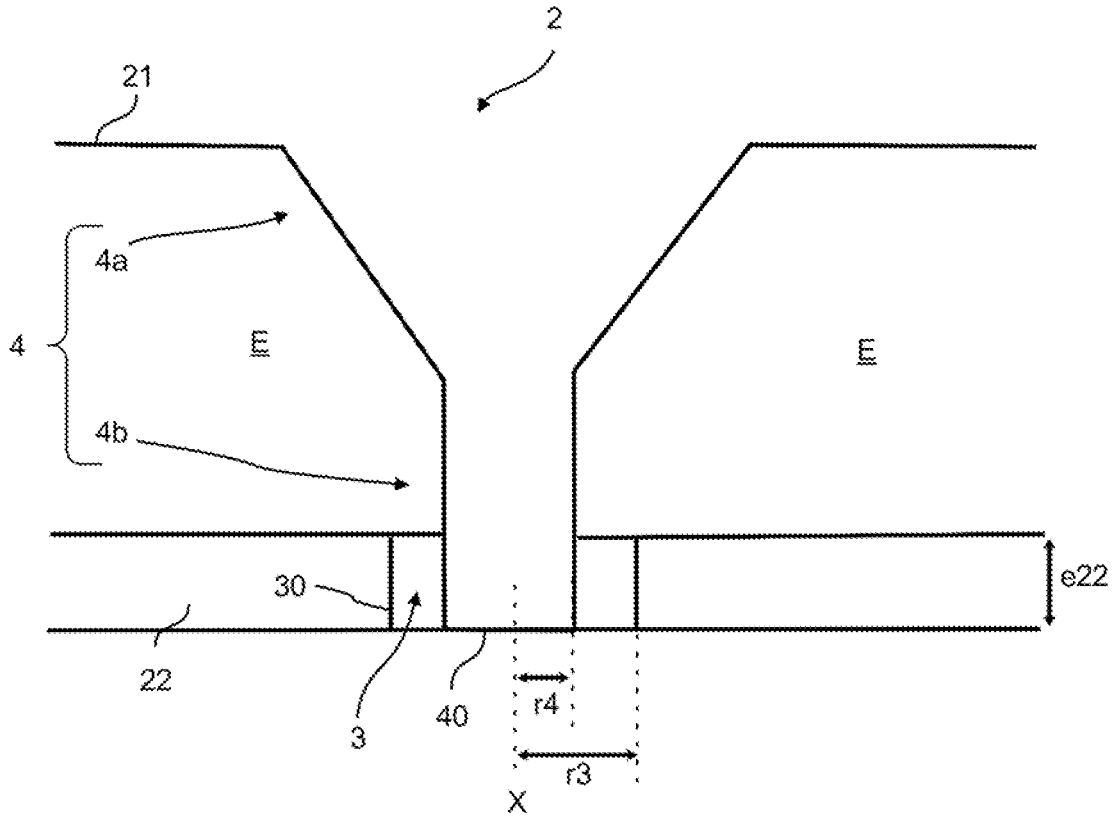
FIG. 6 is a schematic cross-sectional representation of the positioning of a projecting member in a port of the outer wall of the double wall.

With reference to FIG. 6, a schematic cross-section view of a projecting member 4 mounted in a port 3 is represented.

In this example, the projecting member 4 has a flared cross-section towards the inner wall 21. A flared cross-section allows the projecting member 4 to have a wide base ensuring a robust connection with the inner wall 21.

Subsequently, with reference to FIG. 6, for each projecting member 4, a foot portion 4*a* close to the inner wall 21 and a head portion 4*b*, forming the free end of the projecting member 4, which extends into the port 3, are defined. The foot portion 4*a* has a larger cross-section than the head portion 4*b*. In this example, the foot portion 4*a* has a frustoconical cross-section providing high robustness. The head portion 4*b* in turn is cylindrical and preferably has a circular cross-section with radius r4. Preferably, the foot portion 4*a* has a cross-section at least 50%, preferably at least 100% greater than the radius r4.

With reference to FIG. 6, each projecting member 4 extends away from the peripheral edge 30 of the port 3 into which it extends. In other words, there is no contact capable of causing heat conduction between the projecting member 4 belonging to the inner wall 21 and the peripheral edge 30 of the port 3 belonging to the outer wall 22. There is no heat transfer by conduction between the inner wall 21 and the outer wall 22 via the projecting members.

Advantageously, the projecting member 4 is centered in the port 3 so that the calibrated cross-section is adapted between the head portion 4*b* and the port 30, preferably with annular shape. As the combustion chamber rises in temperature, thermal expansions will increase the flow cross-section area of the cooling air flow to achieve optimum cooling. The calibrated cross-section makes it possible to adapt the cooling air flow rate in order to use the cooling air flow sparingly.

Preferably, the radius r3 of the port 3 is greater than the radius r4 of the projecting member 4 in order to define a sufficient flow cross-section for the cooling air F. The radius r3 of the port 3 is greater than the radius r4 by at least 10%, still preferably by at least 30%, yet preferably by at least 100%. The space between the projecting member 4 and the peripheral edge 30 of the port 3 defines a clearance which allows expansion of the projecting member 4. As will be set forth later, in the expanded state, each projecting member 4 extends away from the peripheral edge 30 of the port 3 into which it extends. Therefore, any heat conduction between a projecting member 4 and the outer wall 22 is avoided. Preferably, as illustrated in FIG. 6, each projecting member 4 is in the form of a part of revolution about an axis X that is locally orthogonal to the walls 21, 22.

Still with reference to FIG. 6, the head portion 4*b* has a planar end face 40. In this example, the planar end face 40 extends in continuity with the external surface of the outer wall 22 as illustrated in FIG. 6. As a result, the projecting member 4 does not extend externally to the outer wall 22, which avoids formation of turbulence and improves circulation of the cooling air flow.

Figure 7:
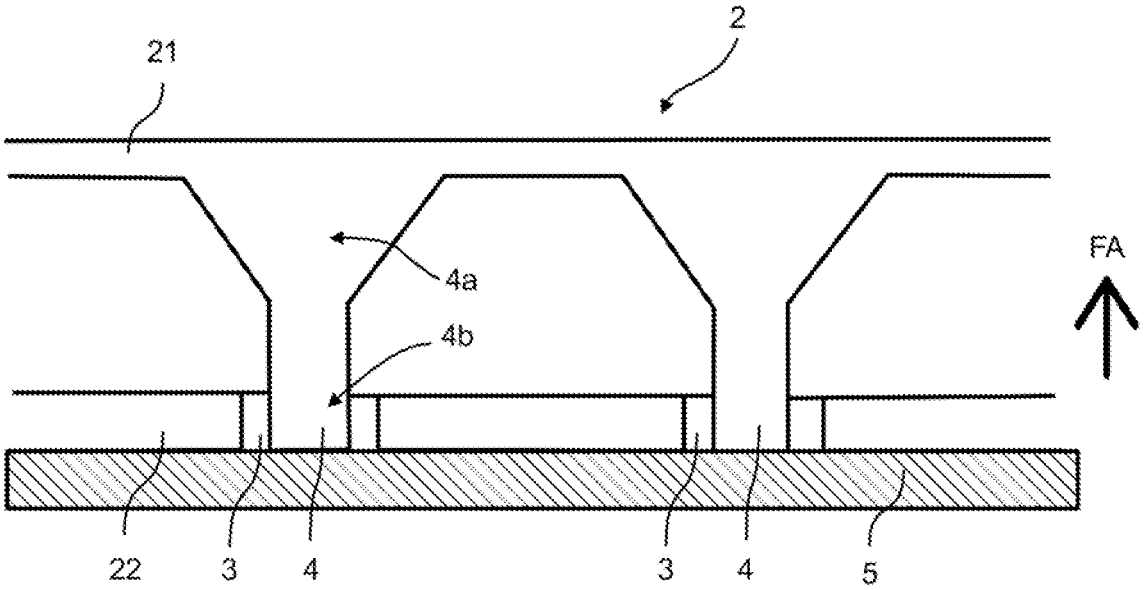
FIG. 7 is a schematic cross-section view of additively manufacturing the double wall and FIG. 8 is a schematic representation in a cross-section view of the circulation of a cooling air flow through the double wall upon using the combustion chamber.

Preferably, with reference to FIG. 7, the double wall 2 is additively manufactured in order to obtain optimum alignment between the projecting members 4 and the ports 3. As illustrated in FIG. 7, the double wall 2 is formed on a temporary support 5, and then the double wall 2 is formed by successive depositions incrementally along a vertical direction FA. Thus, the external wall 22 and the head portion 4*b* of the projecting member 4 are made prior to the foot portion 4*a* of the projecting member 4 and to the internal wall 21. The projecting members 4 advantageously fulfill a function of supporting the inner wall 21 during additive manufacturing, which achieves optimum alignment between the projecting members 4 and the ports 3.

According to an exemplary implementation, during manufacture, the walls 21, 22 are secured to the temporary support 5 by incremental addition of metal powders. The assembly is then depowdered and heat treated. The walls 21, 22 are unsecured from the temporary support 5 by cutting at the interface between the walls 21, 22 and the temporary support 5. Such additive manufacturing advantageously makes it possible to obtain original and innovative geometries while reducing thicknesses. Furthermore, such additive manufacturing does not require the use of a mold for manufacturing, which is a source of savings. It goes without saying that walls 21 and 22 could also be manufactured by a combination of mechanically welded or foundry-obtained parts.

Figure 8:
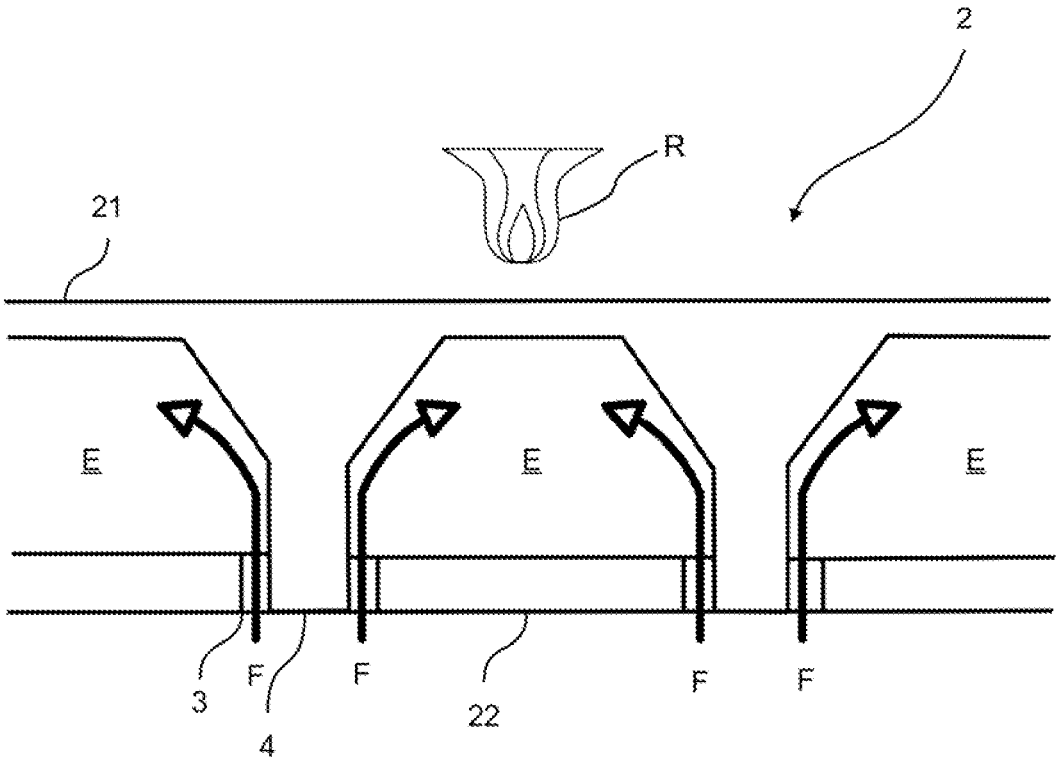

The inner wall 21 and the outer wall 22 are then mounted in the combustion chamber 1 so as to provide a space E therebetween as illustrated in FIG. 8. Due to the precise manufacturing, each projecting member 4 optimally cooperates with a port 3 to offer a calibrated flow cross-section between the projecting member 4 and the port 3 for the passage of a cooling air flow F. Installation with flag yards or the like can be implemented.

An exemplary implementation of the invention will now be set forth with reference to FIG. 8. During operation of the turbomachine, the method comprises:

a combustion step R in the combustion chamber 1 which raises the temperature of the inner wall 21 and a step of circulating a cooling air flow F from the outside via each calibrated flow cross-section of the outer wall defined between a projecting member 4 and the port 3 into which it extends so as to cool the inner wall 21.

Advantageously, the cooling air flow F moves in the space E formed between the inner wall 21 and the outer wall 22 via the calibrated flow cross-section. The cooling air flow F makes it possible to come into contact with the entire surface area of the projecting member 4, which allows heat exchanges to be maximized.

Preferably, during operation, each projecting member 4 thermally expands. In the expanded state, each projecting member 4 extends away from the peripheral edge 30 of the port 3 into which it extends. Therefore, any heat conduction between a projecting member 4 and the outer wall 22 is avoided.

By virtue of the invention, the double wall 2 can be optimally cooled by cooling air flows F without the risk of creating weak or break points. The presence of projecting members 4 increases the heat exchange surface area and calibrates the flow cross-section of the cooling air flow F.

The invention claimed is:

1. A method for making a double wall for a combustion chamber for an aircraft gas turbine, the double wall comprising:

an inner wall configured to be in contact with a combustion reaction; and an outer wall, spaced apart from the inner wall, the inner wall and the outer wall being additively manufactured, the outer wall comprising a plurality of ports so as to allow circulation of cooling air flow, external to the outer wall, which cool the inner wall, the inner wall being free from perforation so as to prohibit any circulation of the cooling air flow to a center of the combustion chamber, wherein the inner wall comprises a plurality of projecting members projecting towards the outer wall, each of the projecting members comprising a foot portion and a cylindrical head portion of circular cross-section, the cylindrical head portion extending into a circular cross-section port of the plurality of ports in order to define a calibrated flow cross-section between the projecting member and the port for the passage of the cooling air flow, wherein the inner wall and the outer wall are secured to a temporary support by incremental addition of metal powders and then unsecured from the temporary support by cutting at an interface between the inner wall, the outer wall, and the temporary support.

2. The method according to claim 1, wherein each of the ports includes a peripheral edge, and wherein each of the projecting members extends away from the peripheral edge of the port.

3. The method according to claim 1, wherein each of the projecting members are remote from the outer wall.

4. The method according to claim 1, wherein the calibrated flow cross-section is peripheral.

5. The method according to claim 1, wherein the foot portion has a flared cross-section towards the inner wall.

6. The method according to claim 1, wherein the outer wall comprises an outer face, and wherein each of the projecting members comprise an end face extending as an extension to the outer face of the outer wall.

7. The method according to claim 1, wherein the inner wall is configured to be in contact with the combustion reaction.

8. The method according to claim 1, wherein the calibrated flow cross-section is annular.

* * * * *